United States Patent [19]

Deasey

[11] Patent Number: 4,662,123

[45] Date of Patent: May 5, 1987

[54] GRINDER APPARATUS

[76] Inventor: Paul Deasey, R.D. 1, Box 541, Everett, Pa. 15537

[21] Appl. No.: 818,104

[22] Filed: Jan. 13, 1986

[51] Int. Cl.[4] ..... B24B 15/02

[52] U.S. Cl. ..... 51/241 A; 51/245

[58] Field of Search ..... 51/241 R, 241 S, 241 B, 51/241 VS, 241 A, 245, 119, 120

[56] References Cited

U.S. PATENT DOCUMENTS

| | | | |
|---|---|---|---|
| 1,929,439 | 10/1933 | Metcalf | 51/120 |
| 2,649,669 | 8/1953 | Tobis | 51/120 |
| 2,948,087 | 8/1960 | Caton | 51/120 |
| 3,421,168 | 1/1969 | Bartel . | |
| 4,519,169 | 5/1985 | Smith | 51/241 S |

*Primary Examiner*—Roscoe V. Parker

*Attorney, Agent, or Firm*—Parmelee, Miller, Welsh & Kratz

[57] ABSTRACT

Grinder apparatus, especially for simultaneously grinding two axially-aligned, but radially and longitudinally spaced annular valve seat surfaces, that includes a rotatable shaft, a plate, rotating on the same axis of rotation as the rotatable shaft, disposed about one end of the rotatable shaft and extending laterally outwardly from the rotatable shaft, two grinders rotatably mounted on the plate on axes parallel with, but spaced at different distances from the axes of rotation of the rotatable shaft and the rotatable plate, the end surfaces of the grinders being disposed at different distances from the outer face of the plate, a pair of motors for separately rotating the rotatable shaft and the plate and a drive for transmitting rotational movement of the rotatable shaft to the grinders mounted on the plate, such that one of the grinders engages one of the annular valve seat surfaces during the grinding operation and the other grinder engages the other of the annular valve seat surfaces during the grinding operation.

22 Claims, 5 Drawing Figures

GRINDER APPARATUS

FIELD OF THE INVENTION

This invention relates to grinder apparatus suitable for grinding valve seat surfaces, more particularly a portable grinder apparatus for simultaneously grinding two axially-aligned, but radially and longitudinally spaced annular valve seat surfaces in a pump, especially valve seat surfaces in pumps used in the petroleum oil fields during drilling operations for circulating a drilling fluid in the oil well to facilitate the drilling operation.

BACKGROUND OF THE INVENTION

Pumps used to circulate drilling fluids in oil wells during drilling operations are large because of the large amounts of drilling fluids required during the operation. These drilling fluids, generally aqueous, carry large amounts of additives, such as clays, to control various properties of the drilling fluids, such as density and viscosity, to assist in the removal of additives, drill cuttings etc., from the well, to lubricate the drill bit, etc. Because the materials carried by the drilling fluids can be abrasive, and the amounts carried are large, they tend to erode quickly the inner surfaces of the pump, particularly the valve seat surfaces thereof. For this reason these pumps require constant and careful maintenance in order to reduce the amount of shut-down time during the drilling operation. To move the damaged pumps from the drilling field to a location wherein the valve seat surfaces thereof can be ground so the pumps can be returned to the operation is costly, because of the time and money required to remove the pump from the oil field site, the long waiting period required for the pump to be repaired, and the additional expense and time required to return the pump to operation. Additionally, some of these pumps can have valves with two axially-aligned, but radially and longitudinally spaced annular valve seat surfaces. In these pumps, each valve surface may have to be ground separately, additionally adding to the cost of servicing the same.

The novel grinding apparatus defined and claimed herein is particularly adapted to alleviate the problems described above, for it is possible, permitting it to be used in the oil field without moving the pump from its fixed location, and it can be used to grind simultaneously two axially-aligned, but radially and longitudinally spaced annular valve seat surfaces in a valve quickly and effectively. In each of such cases, the cost of servicing such pumps and maintaining the same in operation is substantially reduced.

Apparatus for grinding or polishing surfaces are known. Metcalf in U.S. Pat. No. 1,929,439 discloses a portable machine for grinding flanges on a pipe comprising a grinding head which is rotated inside a housing and a grinding wheel mounted on a shaft journaled eccentrically in the grinding head driven through gears by a center shaft concentric with the grinding head, the grinding head and the concentric shaft being driven by a common motor through separate belts and pulleys. The enter housing is advanced axially on a stand on which it is mounted to adjust the grinding wheel by turning a threaded shaft.

In U.S. Pat. No. 2,649,669 Tobis discloses a device for lapping the flat annular seats in a pop safety valve in situ. Four grinders mounted on a plate rotated by a drive shaft are individually rotated by gears which engage a fixed annular gear on the housing for the unit.

No means appear to be provided for advancing the grinders precisely toward the surfaces to be ground.

Smith shows in U.S. Pat. No. 4,519,169 a portable machine for grinding the beveled gas check seat on 155 mm gun tubes comprising an expending arbor for aligning the device with the bore of the gun, a circular plate mounted on a shaft concentric with the gun bore rotated by a motor through a peripheral gear, and a conical grinder mounted on the rotating plate driven by a separate motor through direct gearing.

SUMMARY OF THE INVENTION

The novel apparatus defined and claimed herein comprises a rotatable shaft and a plate, rotating on the same axis of rotation as the rotatable shaft, disposed about the rotatable shaft at one end thereof and extending laterally outwardly therefrom. At least one grinder is rotatably mounted on the plate on an axis parallel with the axes of rotation of the rotatable shaft and the rotatable plate. In the preferred embodiment two grinders are rotatably mounted on the plate on axes parallel with, but spaced at different distances from, the axes of rotation of the rotatable shaft and the rotatable plate. The grinders are preferably hollow, truncated cone-shaped grinders. In the preferred embodiment wherein two grinders are rotatably mounted on the plate, the outer end surfaces of the grinders are disposed at different distances from the outer face of the plate. Means are provided for rotating the plate and for transmitting rotational movement of the rotatable shaft to the grinders.

The above is mounted in a cylindrical housing, with the rotatable shaft being coaxially disposed therein. The cylindrical housing is provided with means for securely mounting the same to a valve body containing the valve seat surface, or surfaces, which will be ground using the novel grinder apparatus defined herein. In a preferred embodiment, the valve will have two axially-aligned, but radially and longitudinally spaced annular valve seat surfaces therein and said surfaces will be ground simultaneously. The preferred means for securely mounting the grinder apparatus to the valve body involves bolting the same directly thereto.

The novel grinder apparatus herein is provided with means to move the grinder, or grinders, axially into surface contact with the surface, or surfaces, of the valve seat, or seats, to be ground. This depth adjustment provides means for precisely controlling the amount that the valve seats are ground down. Thus, when surface contact is made between a grinder and its respective valve seat, a precise amount of valve seat surface will be ground. To obtain additional grinding, an additional depth adjustment is made and this is continued until the desired amount of grinding has been obtained. To obtain this desired axial movement, the cylindrical housing is provided with threads on at least a portion of the interior surface thereof and a tubular cylindrical depth adjuster is coaxially disposed within the cylindrical housing carrying threads on at least a portion of the outer surface thereof that engage the threads on the interior surface of the cylindrical housing. Means are provided so that as the cylindrical depth adjuster is rotated within the cylindrical housing, the plate carrying the grinder is axially moved toward the valve seat surface until surface contact is made between an individual grinder and the respective valve seat surface to be ground prior to the grinding operation.

A tubular shaft is also axially disposed within the cylindrical depth adjuster and is fixedly attached at one end to the rotatable plate. The other end of the tubular shaft and the end of the rotatable shaft adjacent thereto extend outwardly from the cylindrical housing, and a pulley is mounted at each of these end portions. Parallel rails are mounted on the cylindrical housing in axial alignment therewith. Support means are slidably mounted on these rails carrying a pair of electric motors thereon, each of which electric motors is provided with a drive pulley. One of the drive pulleys is operatively connected, for example, by belts, with the pulley on the tubular shaft and the other with the pulley on the rotatable shaft. The electric motors are preferably pivotally mounted on the support means on axes parallel to the axes of rotation of the pulleys and means are provided to pivot the electric motors about said pivot mounting and to maintain them in a selected position, the purpose of which is to maintain tension on the belts connecting the pulleys. The means to pivot the electric motors about the pivot mounting can comprise turnbolts threadedly movable through a base on each of the electric motors, remote from the pivot mounting, adjacent the support means, into engagement with the support means.

DETAILED DESCRIPTION OF THE PREFERRED EMBODIMENT

Figure 1:
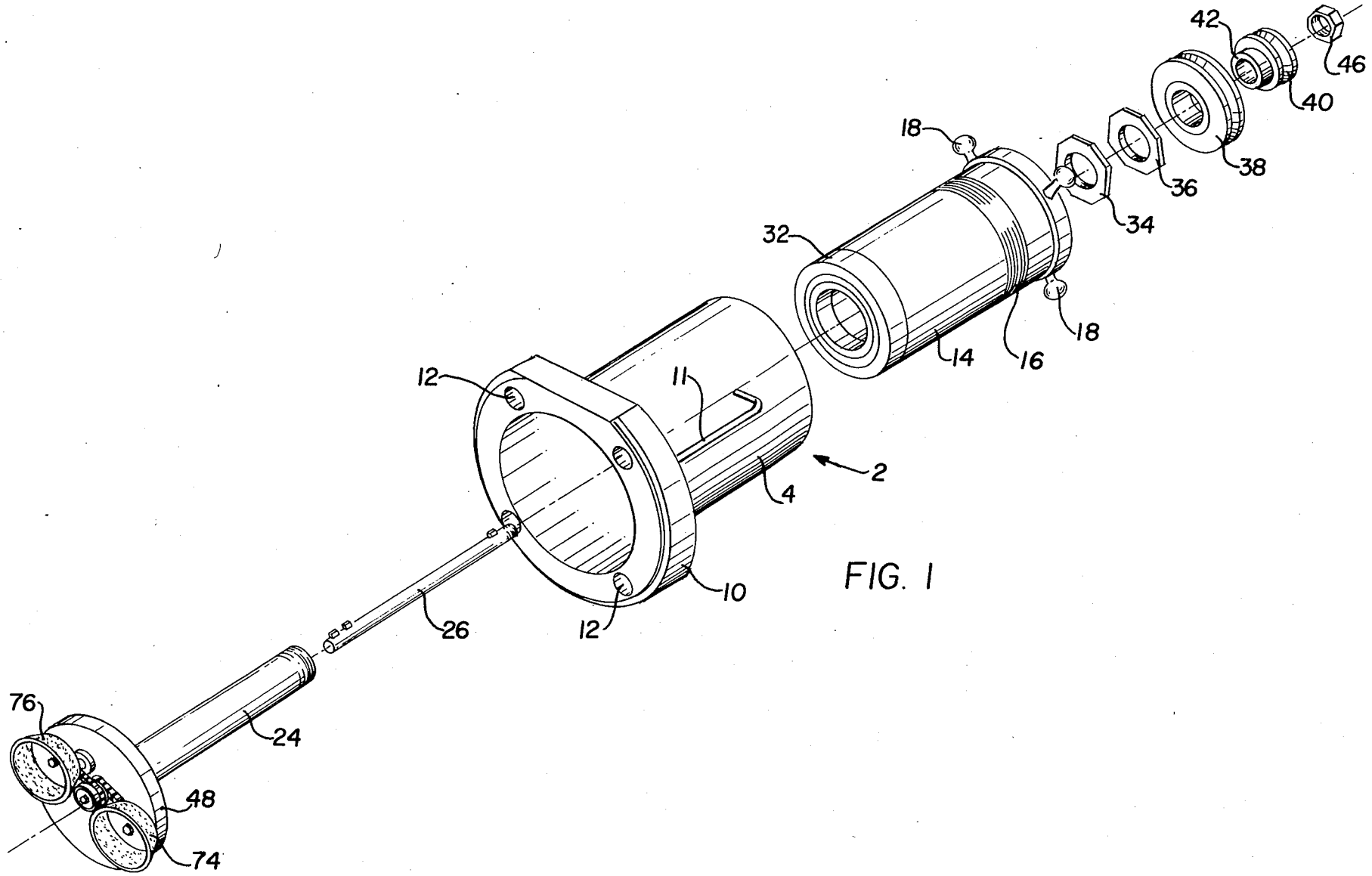
FIG. 1 is a partial exploded perspective view of a portion of the novel grinder apparatus defined and claimed herein.
Figure 2:
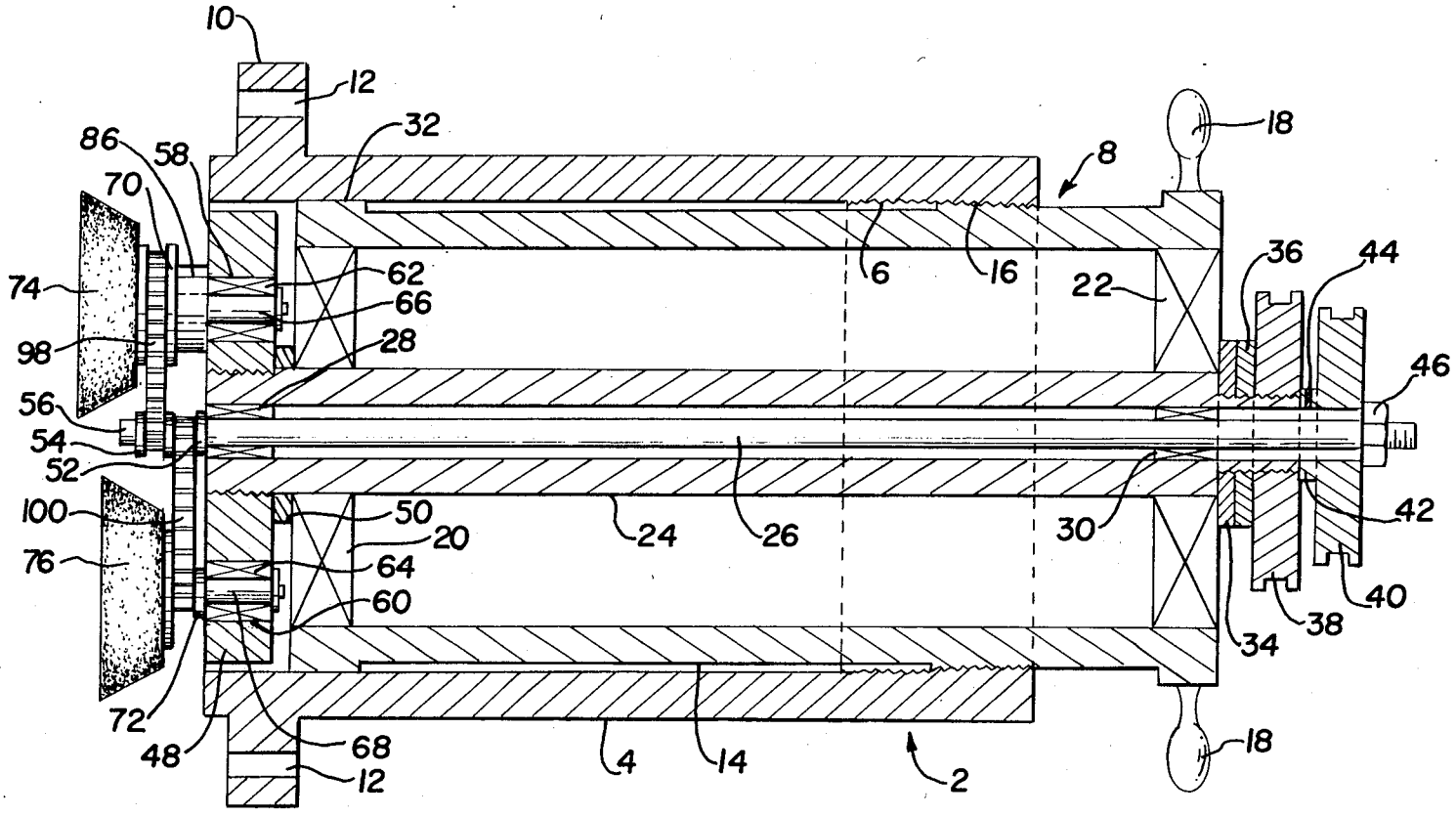
FIG. 2 is a longitudinal sectional view through the assempled components shown in FIG. 1.

Referring to FIGS. 1 and 2, the novel grinder apparatus 2 comprises a cylindrical housing 4 carrying finely-spaced threads 6 on at least a portion of the interior cylindrical surface thereof, preferably adjacent the rear end 8 of the grinder apparatus. The front end of cylindrical housing 4 is provided with a laterally-extending circumferential flange 10 provided with a plurality of bores 12 that extend transversely therethrough. Cylindrical housing 4 is also provided with a pair of handles 11. Coaxially disposed within cylindrical housing 4, and extending outwardly from the rear end thereof, is cylindrical depth adjuster 14 provided with finely-spaced threads 16 that engage interior threads 6 of cylindrical housing 4. Cylindrical depth adjuster 14 is provided on the rear end thereof, extending outwardly from cylindrical housing 4, with a plurality of laterally-extending handles 18 to assist in rotating cylindrical depth adjuster 14 within cylindrical housing 4, resulting in axial movement of cylindrical depth adjuster 14 within cylindrical housing 4. Coaxially disposed within cylindrical depth adjuster 14 and journaled in bearings 20 and 22 at each end thereof is a first tubular shaft 24 extending outwardly from each end of cylindrical depth adjuster 14. A second shaft 26 is coaxially disposed within tubular shaft 24 and is journaled in bearings 28 and 30 mounted within the ends of tubular shaft 24. The outer surface 32 of cylindrical depth adjuster 14, adjacent the front end thereof, is polished and extends outwardly into surface contact with the adjacent inner surface of cylindrical housing 4 to facilitate axial movement of cylindrical depth adjuster 14 within cylindrical housing 4 and to provide a bearing surface therebetween.

The portion of tubular shaft 24 extending outwardly from the rear end of cylindrical depth adjuster 14 is externally threaded to receive hexagonal retaining nuts 34 and 36. Securely mounted adjacent hexagonal nut 36 on tubular shaft 24, by any suitable means, for example, by threading the same on tubular shaft 24, is a first pulley 38. Securely mounted on second shaft 26, by any suitable means, adjacent first pulley 38 is a second pulley 40. The pulley 40 is provided with a hub portion 42 which spaces pulley 40 axially from pulley 38. The hub 42 has set screw means 44 (FIG. 2) for securing pulley 40 to second shaft 26. To insure that pulleys 38 and 40 are maintained in place, a nut 46 is threaded onto second shaft 26 in abutting relationship with the adjacent face of second pulley 40.

A circular plate 48 is threaded onto the tubular shaft 24 adjacent the front end of cylindrical depth adjuster 14. Interposed between plate 48 and bearing 20 in cylindrical depth adjuster 14 is a spacer 50 to maintain plate 48, and portions associated therewith, safely out of contact with cylindrical depth adjuster 14 and bearing 20.

Fixedly attached, by any suitable means, for example, by means of set screws, to the second shaft 26, extending outwardly from the front end of first tubular shaft 24, are first and second sprockets 52 and 54, respectively. The sprockets are maintained in place by means of a nut 56 threaded onto second shaft 26.

Plate 48 is provided with bores 58 and 60 carrying bearings 62 and 64, respectively, in which there are rotatably mounted shafts 66 and 68, the axes of each being in parallel alignment with, but spaced at different distances from, the axes of rotation of tubular shaft 24 and second shaft 26. Fixedly attached to shafts 66 and 68 at the outer end thereof are, respectively, sprockets 70 and 72 and grinders 74 and 76. This arrangement is shown in greater detail in FIG. 3 for the upper grinder assembly as viewed in FIG. 2.

Figure 3:
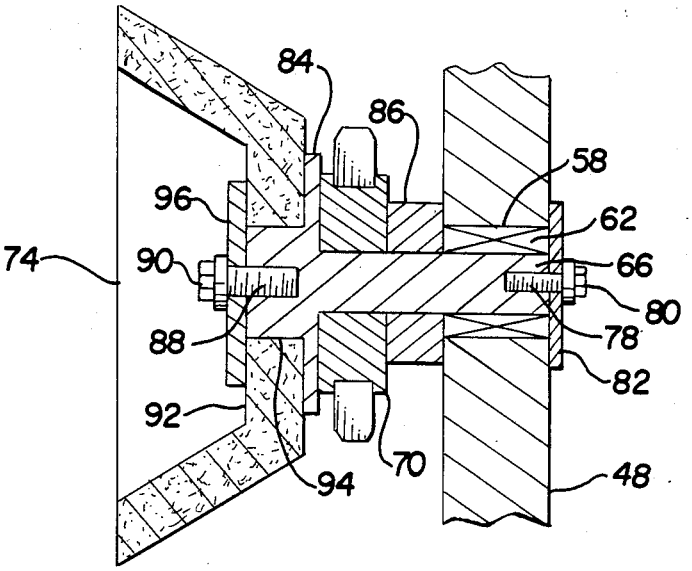
FIG. 3 is a sectional view of one of the grinders attached to its respective shaft.
Figure 4:
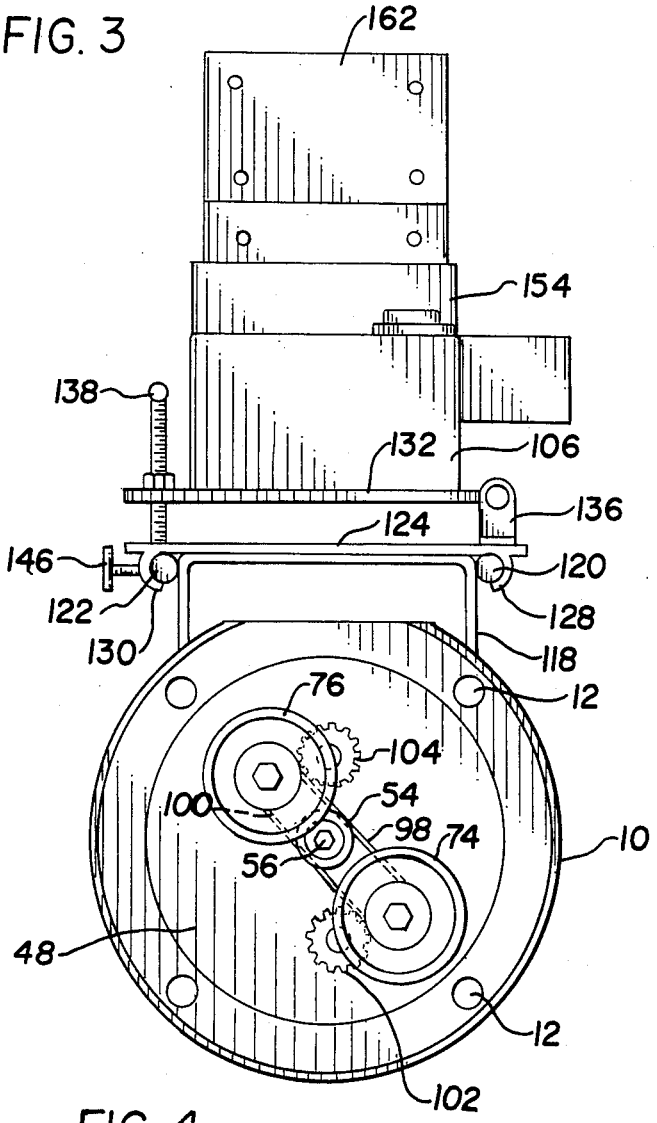
FIG. 4 is a front elevational view of the novel grinder apparatus.

Referring to FIG. 3, the end portion of shaft 66 within bore 58 is internally threaded to receive therein the threaded shank 78 of nut 80. Interposed beteen the head of nut 80 and the adjacent outer surface of plate 48 is a washer 82 having an opening therein through which the threaded shank 78 of nut 80 can pass. The shaft 66 is provided, intermediate the ends thereof, with a laterally-extending circumferential flange 84. Disposed about the shaft 66 adjacent the inner face of circumferential flange 84 is sprocket 70, fixedly attached to shaft 66, for example, by means of a set screw, (not shown). Sprocket 70 is maintained in spaced relationship with the adjacent face of plate 48 by means of spacer 86. The outer free end portion, somewhat enlarged, of shaft 66 is internally threaded axially to receive therein the threaded shank 88 of nut 90 to maintain securely in place thereon hollow, truncated cone-shaped grinder 74. For this purpose, the truncated base 92 is provided with an opening 94 for mounting the same on the free end of shaft 66. To maintain grinder 74 on shaft 66, a washer 96 is positioned between the head of nut 90 and the adjacent face of base 92 of grinder 74. The remaining grinder assembly is similarly mounted on shaft 68, except that a spacer 86 is not used, so that the outer end surfaces of truncated, cone-shaped grinders 74 and 76 are disposed longitudinally at different distances from the adjacent outer face of plate 48 and can be positioned to make surface contact with the two axially-aligned, but radially and longitudinally spaced annular valve seat surfaces in a pump during the grinding operations, described below. Referring to FIG. 2 second sprocket 54 and sprocket 70 are operatively connected by means of endless chain 98 and first sprocket 52 and sprocket 72 are operatively connected by means of endless chain 100. If desired, belt drives can be used in place of the chain drives. Referring to FIG. 4, idler sprockets 102 and 104 are eccentrically mounted on plate 48 in the path of chains 98 and 100, respectively, to maintain tension thereon.

Figure 5:
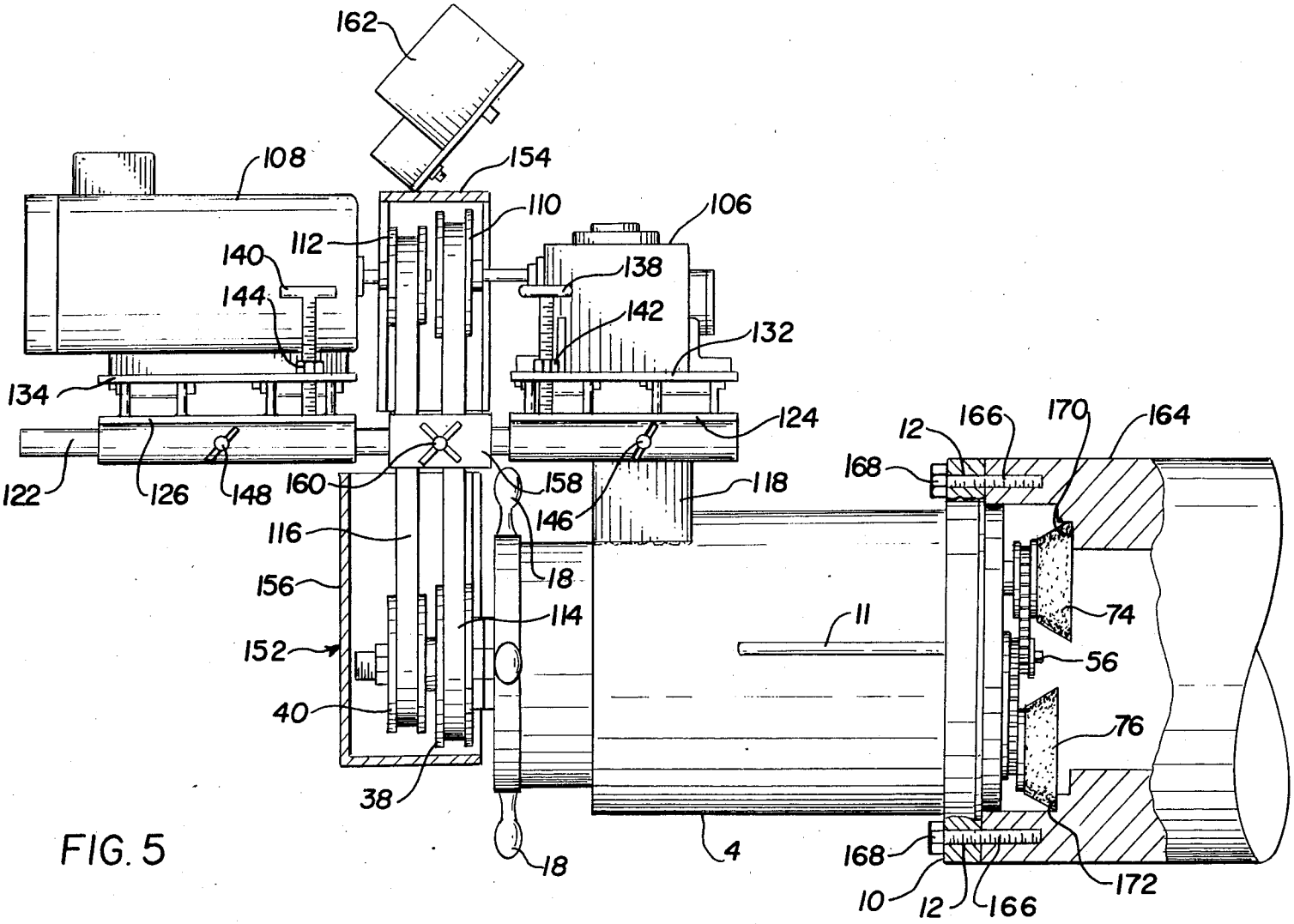
FIG. 5 is a side elevational view, partly in section, of the novel grinder apparatus attached to a valve body in position for grinding valve seat surfaces therein.

Referring to FIGS. 2 and 5, pulley 38 and 40, are driven, respectively, by means of a DC electric motor gear reduction unit 106 and an AC motor 108 provided with drive pulleys 110 and 112. Drive pulleys 110 and 112 are operatively connected to pulleys 38 and 40 through belts 114 and 116, respectively. Means are provided to help maintain pulleys 110 and 112 in alignment with pulleys 38 and 40, respectively, when cylindrical depth adjuster 14 is moved axially. To this end a horizontal base member 118 is securely attached to the upper surface of cylindrical housing 4, and securely attached to said horizontal base member 118 is a pair of parallel slide bars 120 and 122 extending parallel to the axis of cylindrical housing 4. A pair of supports 124 and 126 are slidably mounted on parallel slide bars 120 and 122. To help hold the supports on the bars, portions of supports 124 and 126 adjacent parallel slide bars 120 and 122 are provided with overhanging side flanges 128 and 130, respectively, partially surrounding parallel slide bars 120 and 122. Electric motor unit 106 and electric motor 108 are each provided with a laterally extending base 132 and 134, respectively, to which they are securely attached, by means not shown. Electric motor unit 106 is pivotally mounted to support 124 through one or more hinges 136. Electric motor 108 is similarly mounted to support 126.

To rotate electric motor unit 106 and electric motor 108 about their pivot points, and thereby control tension on belts 114 and 116, the free edge of each base 132 and 134 adjacent slide bar 122 is provided with threaded openings through which turnbolts 138 and 140 can pass laterally therethrough into contact with the adjacent upper surface of supports 124 and 126, respectively. To maintain electric motor unit 106 and electric motor 108 in a fixed angular position, bolts 138 and 140 are provided with lock nuts 142 and 144. To maintain supports 124 and 126 in a fixed location, the overhanging flanges 130 thereon adjacent slide bar 122 are provided with threaded openings through which threaded turnbolts 146 and 148 can pass laterally therethrough into frictional engagement with the adjacent surface of slide bar 122. Similar means can also be provided on the overhanging flanges 128.

A safety guard housing 152 is employed surrounding both pairs of pulleys 38 and 40 and 110 and 112, as well as their respective belt drives 114 and 116, comprising upper housing portion 154 and a lower housing portion 156 fixedly attached to a support 158 slidable on parallel slide bars 120 and 122. Support 158 is similar to supports 124 and 126, except that in the horizontal portion thereof openings are provided for movement of belts 114 and 116 therethrough. The housing 152 is maintained in place by means of threaded turnbolt 160 that passes laterally through a threaded opening in an overhanging flange portion of support 158 into frictional engagement with the adjacent slide bar 122. A similar means can be provided on the opposite side of support 158 for maintaining the same in fixed position. If desired, a single support slidable on parallel slide bars 120 and 122 can be used in place of individual supports 124, 126 and 158. A control box 162 can be fixedly mounted on the upper portion 154 for operating the electric motors, and other facilities, during the grinding operation, described below.

To carry out the desired grinding operation using the novel grinding apparatus defined and claimed herein, the grinder apparatus 2 is lifted by means of handles 11 on cylindrical housing 4 and is moved into position adjacent valve body 164 after the cover thereof (not shown) and the valve members (not shown) have been removed (FIG. 5). The front end of the grinder apparatus carrying the grinders 74 and 76 is then moved into valve body 164 until the circumferential flange 10 of the cylindrical housing 4 is in surface contact with the outer face of valve body 164 and bores 12 in cylindrical housing 4 are in axial alignment with tapped bores 166 in valve body 164. Tapped bores 166 are the openings in the valve body 164 which helped to facilitate the attachment of the valve body cover to the valve body. Threaded bolts 168 are then inserted in aligned bores 12 and 166 and rotated until cylindrical housing 4 and valve body 164 are firmly attached to each other.

Using handles 18 on cylindrical depth adjuster 14, an operator rotates the latter and thereby axially advances the same until grinders 74 and 76 make surface contact with axially-aligned, but radially and longitudinally spaced annular valve seat surfaces 170 and 172, respectively. To maintain alignment of pulleys 110 and 112 with their corresponding pulleys 38 and 40 when cylindrical depth adjuster 14 is moved axially within cylindrical housing 4, supports 124, 126 and 158 are moved a corresponding distance along slide bars 120 and 122. To obtain sufficient tension on drive belts 114 and 116, electric motor unit 106 and electric motor 108 can be pivoted about their respective supports 124 and 126 by means of turnbolts 138 and 140 until the desired tension is obtained.

The desired grinding operation can then be started. It can be seen from FIG. 5 that since grinder 74 revolves about an axis closer to the axis of rotation of second shaft 26 than does grinder 76, and that the outer surface of grinder 74 is located at a distance further from the face of plate 48 than is the outer surface of grinder 76, effective contact is made between grinder 74 and valve seat surface 170 and between grinder 76 and valve seat surface 172. As tubular shaft 24 rotates, plate 48 rotates with it, and as second shaft 26 rotates, rotational movement is imparted to the grinders 74 and 76. Therefore, the entire annular valve seat surfaces 170 and 172 are continuously and uniformly contacted with the grinders 74 and 76. After the valve seat surfaces have been ground, and no further surface material is being removed therefrom, but additional grinding is desired, cylindrical depth adjuster 14 is again advanced axially until contact is made between the grinders and their respective valve seats and grinding can continue. In this way, the depth adjuster can be axially advanced to control precisely the amount of valve seat surface one desires to remove by grinding. Thus, a grinder apparatus designed in accordance with the description hereinabove has been provided with a depth adjuster which advances axially 55/1000-inch for each revolution. After the valve seat surfaces have been ground to the extend desired, the grinder apparatus is removed therefrom, reversing the procedure defined above for mounting the same on the valve body.

Although two grinders have been described in the embodiment above, with each grinder being shown as being a hollow, truncated cone-shaped grinder, it is understood that the novel apparatus herein can be used employing but one grinder and that such grinders need not be hollow, truncated cone-shaped grinders but can have flat grinding surfaces or other surfaces adapted to be aligned with the valve seat surfaces to be ground.

What is claimed is:

1. Grinder apparatus for simultaneously grinding two axially-aligned but radially and longitudinally spaced annular valve seat surfaces, comprising: a rotatable shaft, a plate, rotating on the same axis of rotation as said rotatable shaft, disposed about said rotatable shaft at one end thereof and extending laterally outwardly therefrom, two grinders mounted on said plate on axes parallel with, but spaced at different distances from, the axes of rotation of said rotatable shaft and said rotatable plate, the end surfaces of said grinders being disposed at different distances in the axial direction from the outer face of said plate, means for rotating said rotable shaft, separate means for rotating said plate and means for transmitting rotational movement of said rotatable shaft to said grinders so that one of said grinders engages one of said annular valve seat surfaces during the grinding operation and the other of said grinders engages the other of said annular valve seat surfaces furing the grinding operation.

2. The grinder apparatus of claim 1 wherein said annular valve seat surfaces are disposed in a valve body, a cylindrical housing is provided in which said rotatable shaft and said plate are coaxially disposed, said cylindrical housing being provided with means for securely mounting the same to said valve body, so that said grinders can be positioned into engagement with said annular valve seat surfaces.

3. The grinder apparatus of claim 2 wherein said cylindrical housing carries a circumferential flange thereon with a plurality of bores therein aligned with bores in said valve body through which bolts are positioned to bolt said cylindrical housing to said valve body.

4. The grinder apparatus of claim 2 including adjustment means to move said grinders axially into precise engagement with said annular valve seat surfaces.

5. The grinder apparatus of claim 4 wherein said adjustment means includes threads on at least a portion of the interior surface of said cylindrical housing, and a tubular cylindrical depth adjuster coaxially disposed within said cylindrical housing carrying threads on at least a portion of the outer surface thereof engaging said threads on said cylindrical housing, said grinder apparatus also including a tubular shaft coaxially disposed within said cylindrical depth adjuster and fixedly attached at one end thereof to said plate, said rotatable shaft being coaxially disposed within said tubular shaft, said tubular shaft and said rotatable shaft being rotatable within, but secured to, said cylindrical depth adjuster, whereby rotational movement of said cylindrical depth adjuster within said cylindrical housing results in axial movement of said depth adjuster within said cylindrical housing and in axial movement of said grinders into said engagement with said valve seat surfaces.

6. The grinder apparatus of claim 1 wherein said grinders are hollow, truncated cone-shaped grinders.

7. The grinder apparatus of claim 1 wherein said annular valve seat surfaces are disposed within a valve body, a cylindrical housing is provided in which said rotatable shaft and said plate are coaxially disposed, said cylindrical housing having threads on at least a portion of the interior surface thereof, said cylindrical housing being provided with means for securely mounting the same to said valve body such that said grinders can be positioned into engagement with said annular valve seat surfaces, said means for securely mounting said cylindrical housing to said valve body comprising a circumferential flange on said cylindrical housing having a plurality of bores therein aligned with bores in said valve body through which bolts can be positioned to bolt said cylindrical housing to said valve body, means to move said grinders axially into precise engagement with said annular valve seat surfaces comprising a tubular cylindrical depth adjuster coaxially disposed within said cylindrical housing carrying threads on at least a portion of the outer surface thereof engaging said threads on said cylindrical housing and a tubular shaft coaxially disposed within said cylindrical depth adjuster and fixedly attached thereto at one end there to said plate, said rotatable shaft being disposed within said tubular shaft, said tubular shaft and said rotatable shaft being rotatable within, but secured to, said cylindrical depth adjuster for axial movement therewith.

8. Grinder apparatus comprising a cylindrical housing carrying threads on at least a portion of the interior surface thereof, a tubular cylindrical depth adjuster coaxially disposed within said cylindrical housing carrying threads on at least a portion of the exterior surface thereof engaging said threads on said cylindrical housing, a first tubular shaft, coaxially disposed within said cylindrical depth adjuster fixedly carrying a plate at one end thereof that extends laterally outwardly therefrom, a second shaft coaxially disposed within said first shaft extending at each end outwardly therefrom, at least one grinder mounted on said plate on an axis offset laterally from but parallel with the axes of rotation of said first tubular shaft and said second shaft and extending axially outwardly therefrom, means for rotating said first tubular shaft, separate means for rotating said second shaft and means to transmit rotational movement of said second shaft to said grinder.

9. The grinder apparatus of claim 8 wherein two grinders are mounted on said plate on axes parallel with, but spaced at different distances from, the axes of rotation of said first tubular shaft and said second shaft, the end surfaces of said grinders being disposed at different distances in the axial direction from the outer face of said plate.

10. The grinder apparatus of claim 9 wherein said grinders are hollow, truncated cone-shaped grinders.

11. The grinder apparatus of claim 9 wherein said grinder apparatus is adapted for simultaneously grinding two axially-aligned, but radially and longitudinally spaced annular valve seat surfaces disposed in a valve body, wherein said cylindrical housing is provided with means for securely mounting the same to said valve body, such that said grinders can be positioned into engagement with said annular valve seat surfaces.

12. The grinder apparatus of claim 11 wherein said cylindrical housing carries a circumferential flange thereon with a plurality of bores therein aligned with bores in said valve body through which bolts can be positioned to bolt said cylindrical housing to said valve body.

13. The grinder apparatus of claim 11 wherein said tubular shaft and said rotatable shaft are rotatable within, but secured to, said cylindrical depth adjuster, whereby rotational movement of said cylindrical depth adjuster within said cylindrical housing results in axial movement of said depth adjuster within said cylindrical housing and in axial movement of said grinders into engagement with said valve seat surfaces.

14. The grinder apparatus of claim 8 wherein two grinders are mounted on said plate on axes parallel with, spaced at different distances from, the axes of rotation of said first tubular shaft and said second shaft, the end surfaces of said grinders being disposed at different distances in the axial direction from th outer face of said plate, said grinders being hollow, truncated cone-shaped grinders, said grinders being adapted for simultaneously grinding two axially-aligned, but radially and longitudinally spaced annular valve seat surfaces disposed in a valve body, said cylindrical housing being provided with a circumferential flange thereon with a plurality of bores therein aligned with bores in said valve body through which bolts can be positioned to bolt said cylindrical housing to said valve body, said tubular shaft and said rotatable shaft being rotatable within, but secured to, said cylindrical depth adjuster, whereby rotational movement of said cylindrical depth adjuster within said cylindrical housing results in axial movement of said depth adjuster within said cylindrical housing and in axial movement of said grinders into engagement with said valve seat surfaces.

15. Grinder apparatus comprising a cylindrical housing, a tubular cylindrical depth adjuster coaxially disposed within said cyclindrical housing and attached thereto by engagement of threads on at least a portion of the exterior surface thereof with threads on at least a portion of the inner surface of said cylindrical housing, a first tubular shaft coaxially disposed within said cylindrical depth adjuster fixedly carrying a plate at one end thereof that extends laterally outwardly therefrom, a second shaft coaxially disposed within said first shaft extending at each end outwardly therefrom, at least one grinder rotatably mounted on said plate on an axis offset laterally from but parallel with the axes of rotation of said first tubular shaft and said second shaft and extending outwardly therefrom, a first pulley mounted on the outer end of said first tubular shaft, a second pulley mounted on said second shaft adjacent said first pulley, parallel rails mounted on said cyclindrical housing and extending parallel to the axis of said cylindrical housing, support means slidably mounted of said parallel rails, a pair of electric motor units, each provided with a drive pulley, mounted on said support means, one of said drive pulleys operatively connected with said pulley on said first tubular shaft, the other of said drive pulleys operatively connected with said pulley on said second shaft, and means to transmit rotational movement of said second shaft to said grinders on said plate.

16. The grinder apparatus of claim 15 wherein two grinders are mounted on said plate on axes parallel with, but spaced at different distances from, the axes of rotation of said first tubular shaft and said second shaft, the end surfaces of said grinders being disposed at different distances from the outer face of said plate.

17. The grinder apparatus of claim 16 wherein said grinders are hollow, truncated cone-shaped grinders.

18. The grinder apparatus of claim 15 wherein said electric motor units are pivotally mounted on axes parallel to the axes of rotation of said pulleys.

19. The grinder apparatus of claim 15 wherein said grinder apparatus is adapted for simultaneously grinding two axially-aligned, but radially and longitudinally spaced annular valve seat surfaces disposed in a valve body, wherein said cylindrical housing is provided with means for securely mounting the same to said valve body, such that said grinders can be positioned into engagement with said valve seat surfaces.

20. The grinder apparatus of claim 19 wherein said cylindrical housing carries a circumferential flange thereon with a plurality of bores therein aligned with bores in said valve body through which bolts can be positioned to bolt said cylindrical housing to said valve body.

21. The grinder apparatus of claim 19 wherein said tubular shaft and said rotatable shaft are rotatable within, but secured to, said cylindrical depth adjuster, whereby rotational movement of said cylindrical depth adjuster within said cylindrical housing results in axial movement of said depth adjuster within said cylindrical housing an in axial movement of said grinders into engagement with said valve seat surfaces.

22. The grinder apparatus of claim 15 wherein two grinders are mounted on said plate on axes parallel with, but spaced at different distances from, the axes of rotation of said first tubular shaft and said second shaft, the end surfaces of said grinders being disposed at different distances in the axial direction from the outer face of said plate, said grinders being hollow, truncated cone-shaped grinders, one of said electric motor units being a DC electric motor gear reduction unit operatively connected to said pulley mounted on said tubular shaft, the other of said electric motor units being an AC motor operatively connected with said pulley mounted on said second shaft, said electric motor units being mounted on axes parallel to the axes of rotation of said pulleys, said grinders being adapted for simultaneously grinding two axially-aligned, but radially and longitudinally spaced annular valve seat surfaces disposed in a valve body, said cylindrical housing being provided with a plurality of bores therein aligned with bores in said valve body through which bolts can be positioned to bolt said cylindrical housing to said valve body, said tubular shaft and said rotatable shaft being rotatable within, but secured to, said cylindrical depth adjuster, whereby rotational movement of said cylindrical depth adjuster within said cylindrical housing results in axial movement of said depth adjuster within said cylindrical housing and in axial movement of said grinders into engagement with said valve seat surfaces.

* * * * *